US006901941B2

(12) United States Patent
Gershtein et al.

(10) Patent No.: US 6,901,941 B2
(45) Date of Patent: Jun. 7, 2005

(54) VESSEL WITH OPTIMIZED PURGE GAS FLOW AND METHOD USING SAME

(75) Inventors: Vladimir Yliy Gershtein, Allentown, PA (US); Pingping Ma, Orefield, PA (US); Steven W. Hoffman, Reading, PA (US); Christopher R. Butler, Allentown, PA (US); John Frederick Cirucci, Schnecksville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 255 days.

(21) Appl. No.: 10/192,481

(22) Filed: Jul. 10, 2002

(65) Prior Publication Data

US 2004/0007272 A1 Jan. 15, 2004

(51) Int. Cl.[7] ..... B08B 5/00

(52) U.S. Cl. ..... 137/15.04; 137/574; 134/22.18; 220/563

(58) Field of Search ..... 137/899, 574, 137/15.04, 240; 280/837; 220/562, 563, DIG. 24; 134/22.18

(56) References Cited

U.S. PATENT DOCUMENTS

| | | | | | |
|---|---|---|---|---|---|
| 1,924,741 | A | * | 8/1933 | Shoulter et al. | 220/563 |
| 2,664,911 | A | * | 1/1954 | Thompson et al. | 220/563 |
| 2,668,634 | A | * | 2/1954 | Arne | 220/563 |
| 2,675,682 | A | * | 4/1954 | Dobson | 220/563 |
| 2,860,809 | A | * | 11/1958 | Perry | 220/563 |
| 3,645,416 | A | * | 2/1972 | Main, Jr. | 220/563 |
| 4,241,755 | A | | 12/1980 | Snyder | 137/899 |
| 4,251,005 | A | | 2/1981 | Sons et al. | 220/22 |
| 4,469,143 | A | * | 9/1984 | Vazin | 134/22.18 |
| 4,483,454 | A | | 11/1984 | Rogers et al. | 220/5 |
| 4,789,170 | A | | 12/1988 | Reber | 280/5 |
| 5,591,273 | A | * | 1/1997 | Tsukamoto et al. | 134/22.18 |
| 6,062,417 | A | | 5/2000 | Evans | 220/563 |
| 6,186,713 | B1 | | 2/2001 | Bonerb | 410/100 |
| 6,220,287 | B1 | | 4/2001 | Wolf | 137/574 |
| 6,443,166 | B1 | * | 9/2002 | Tunney et al. | 134/22.18 |

OTHER PUBLICATIONS

*Rollover of Heavy Commercial Vehicles*, UMTRI Research Review, Oct.–Dec. 2000, vol. 31, #4.

Byrne, R. (Jr.), *Standards of Tubular Exchanger Manufactures Association*, 6th Ed., 1978.

Chenoweth, et al., *Fouling in Heat Exchange Equipment*, The American Society of Mechanical Engineers, HTD–vol. 17.

Incropera, et al., *Introduction to Heat Transfer*, John Wiley & Sons, 3rd Ed.

Kumar, H., *Thermal and hydraulic design of heat exchangers*, Heat Exchanger Design Handbook, Hemisphere Publishing Corporation, Rev. 1989.

* cited by examiner

*Primary Examiner*—John Rivell
(74) *Attorney, Agent, or Firm*—R. P. Morris-Oskanian

(57) ABSTRACT

A vessel for the storage and transportation of bulk volumes of a fluid is described herein and a method for using same. The vessel contains a plurality of dividers that apportion the internal volume into a number of sections. The dividers within the vessel aid in minimizing sloshing of the fluid contained therein during transport. In addition, the dividers optimize the fluid flow pattern thereby allowing for the continuous purge of the vessel without the need for the application of a partial or full vacuum.

12 Claims, 9 Drawing Sheets

VESSEL WITH OPTIMIZED PURGE GAS FLOW AND METHOD USING SAME

BACKGROUND OF THE INVENTION

The present invention relates generally to a fluid containment and delivery vessel. More particularly, the present invention relates to a vessel with optimized flow of a purge gas and a method of using same.

Large vessels, typically cylindrical in shape, are used for the bulk storage and transportation of a fluid. The term "fluid" as used herein denotes liquid as well as gaseous substances. During transportation of relatively large volumes of fluid such as by tractor-trailer or rail car, the fluid within the vessel may tend to slosh forward and aft. This sloshing movement can result in instability within the load and may ultimately lead to rollover of the vessel and/or transportation vehicle, potentially leading to damage to person and property. Further, the continual sloshing movement of the liquid within the vessel can damage the vessel by putting pressure on its welds and joints.

To reduce the destabilization caused by the movement of fluids within the vessel, the vessel may be filled to capacity. This oftentimes may not be possible nor desirable. Further, the Department of Transportation (DOT) regulation 49 CFR Section 173.32(f)(iii)(5) limits the filling of bulk transportation vessels to a filling density of not more than 20% and less than 80% by volume. This filling restriction, however, does not apply if the vessel has dividers that apportion the vessel into compartments of not more than 1,980 gallons capacity.

Dividers, also referred to as baffles, partitions, or surge plates, are used to reduce sloshing of the fluid within the vessel and provide increased stability. Dividers are typically secured at right angles to the anticipated movement of fluids within the tank. Such dividers generally form smaller compartments within the vessel that limit the distance that the liquid can slosh within the tank. Some examples of vessels that contain these types of dividers are described in U.S. Pat. Nos. 1,909,734, 2,011,161, and 4,251,005. U.S. Pat. No. 4,789,170 describes circular shaped, disc baffles that are secured within a tank on a water truck that are designed to attenuate forces directed at them.

One drawback to the use of dividers within bulk fluid storage and delivery vessels is the difficulty in cleaning the interior of the vessel from contaminants prior to use. This step is particularly important when the vessel is used to carry and store high purity (HP) or ultra high purity (UHP) products used for example, in food products, electronics manufacturing, or biomedical applications. The dividers within the tank create "dead zones" or stagnant areas that make it difficult to efficiently remove the contaminants from the internal surface and volume of the vessel. The vessels are typically cleaned through a cycle purge with vacuum application. Vacuum application, however, is not without its drawbacks. Application of vacuum requires structural reinforcement of the vessel walls, which can lead to escalation of the vessel cost. Wall reinforcement can also increase the weight of the vessel, which limits the quantity of product that can be transported. Further, additional equipment, such as vacuum pumps, special valves, and the like need to be available to prepare the vessel prior to use. This additional equipment ultimately increases the operating costs of the vessel. Moreover, there may be an added risk of contaminant entrainment when employing vacuum purging.

Accordingly, there is a need in the art to provide improved vessels to transport and store bulk quantities of a fluid that minimizes the dynamic movement or sloshing of the fluid contained therein. There is a need in the art for vessels and methods using same that eliminate contamination of the fluid contained therein due to inadequate internal surface preparation. There is a need in the art for vessels and methods using same that allow for continuous purging of the internal volume of the vessel. Further, there is a need in the art to minimize the weight of the vessel to ensure maximum product load. Moreover, there is a need in the art to minimize vessel operating costs to ensure competitive product pricing on the market and to ensure maximum revenue.

All references cited herein are incorporated herein by reference in their entirety.

BRIEF SUMMARY OF THE INVENTION

The present invention satisfies some, if not all, of the needs of the art. The vessel of the present invention is used to store and transport bulk quantities of HP and UHP liquids and gases. Further, the vessel allows for the effective purging of contaminants from its internal volume and surfaces without the need to apply partial or full vacuum.

Specifically, in one embodiment of the present invention, there is provided a vessel for the containment and delivery of a fluid, the vessel comprising: a shell having an internal surface and an internal volume; a plurality of dividers contained therein that apportions the internal volume into two or more sections defining two end sections and at least one center section wherein at least a portion of the dividers contacts the internal surface thereby defining one or more apertures and a fluid inlet that extends into the internal volume of the vessel defined by the plurality of dividers. In certain preferred embodiments, the fluid inlet extends into the at least one center section.

In yet another embodiment of the present invention, there is provided a vessel comprising a shell having an internal volume, an internal surface, a proximal end, and a distal end. The shell further comprises at least one fluid inlet that directs fluid into the internal volume of the vessel and is located at substantially the midpoint between the proximal and distal ends of the vessel and a plurality of dividers that contact at least a portion of the internal surface of the shell thereby defining one or more apertures and apportions the internal volume into at least three sections.

In a further embodiment of the present invention, there is provided a method for the continuous purging of contaminants from a vessel, the method comprising: providing a vessel comprising an internal surface, an internal volume, a plurality of dividers that apportions the internal volume into two end sections and an at least one center section wherein at least a portion of the dividers contacts the internal surface of the vessel thereby defining one or more apertures, an at least one fluid inlet that extends into the at least one center section, an at least one fluid outlet; and contaminants contained therein; introducing a stream of gas into the vessel through the at least one fluid inlet wherein the gas flows into the at least one center section and through the apertures of the dividers into the two end sections to form a contaminant-laden stream; and removing the contaminant-laden stream from the vessel through the at least one fluid outlet. In certain preferred embodiments of the present invention, the at least one fluid outlet extends into the at least one center section.

These and other aspects of the invention will become apparent from the following detailed description.

DETAILED DESCRIPTION OF THE INVENTION

The present invention is directed, in part, to a vessel used for the storage and transportation of bulk volumes of a fluid and methods of using same. The vessel of the present invention is used to store and transport bulk quantities of HP and UHP fluids. Further, the vessel also allows for the effective purging of other contaminants from its internal volume and surface without the need to apply partial or full vacuum.

Figure 1:
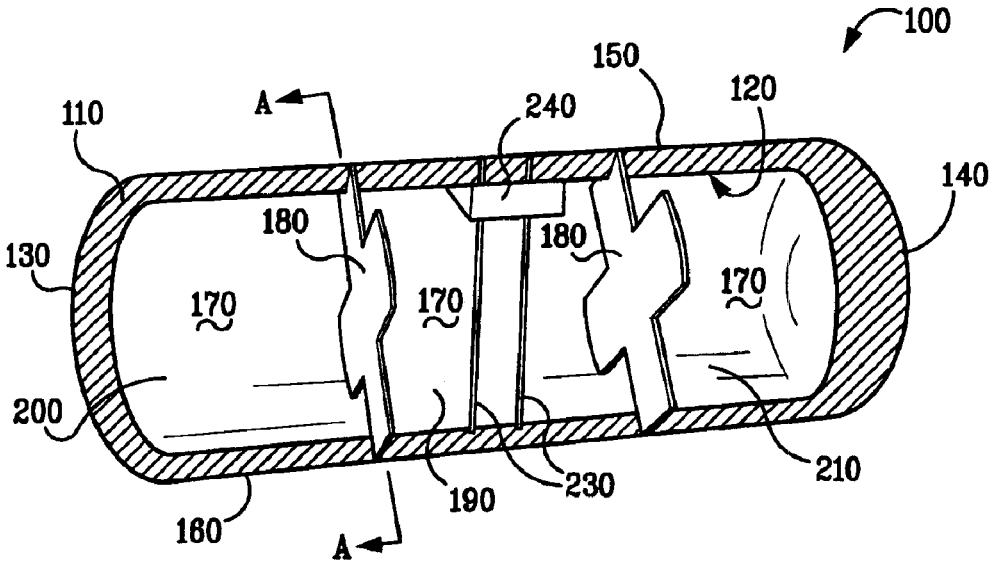
FIG. 1 provides an isometric view of one embodiment of the present invention. wherein the valve box is located within the center section of the vessel.

FIG. 1 provides an illustration of one embodiment of the vessel of the present invention. As FIG. 1 illustrates, vessel 100 is preferably designed to be affixed to a trailer, tractor, or rail car (not shown) to transport fluid contained therein. Vessel 100 has a shell 110, proximal end 130, distal end 140, top 150, and bottom 160. Vessel 100 or shell 110 has an internal surface 120 and internal volume 170 whose size may be determined by physical or legal limitations on the quantity of fluid contained therein. Typical volumes range from about 50 to about 50,000, preferably from about 1,000 to about 12,000, and more preferably from about 2,000 to about 5,500 gallons. Vessel 100 is preferably longer than it is wide or high. Vessel 100 and shell 110 can be a variety of shapes such as cylindrical, rectangular, or square. In certain preferred embodiments, vessel 100 and shell 110 are cylindrical shaped. While FIG. 1 depicts vessel 100 as having a circular cross-section, it is envisioned that vessel 100 can have other cross-sections such as rectangular or elliptical.

Vessel 100 and/or shell 110 may be composed of any material that is compatible with the fluid contained therein and has sufficient structural integrity to withstand the pressure of the fluid under static or dynamic loads. The material selected should also be capable of handling extremes in temperature and environment during vessel use. Some materials that may be used include, but are not limited to, aluminum, stainless steel, carbon steel, fiberglass, or a high strength polymer such as high-density polyethylene. The vessel may be composed of a corrosion-resistant material or may have a corrosion-resistant lining such as, but not limited to, TEFLON™, rubber, or glass (not shown).

Vessel 100 further comprises a plurality of dividers 180 that apportion the internal volume 170 into at least one center section 190 and two end sections, 200 and 210. While dividers 180 are preferably mounted transverse, or perpendicular to the horizontal axis of vessel 100, it is envisioned that other divider installations may be effective. Dividers 180 preferably have a flat surface, as shown in FIG. 1. In alternative embodiments, dividers 180 may have a convex or concave surface for reinforcement purposes. Dividers may be mounted, if flat, parallel with respect to each other, or if concave or convex, antipodally, i.e., with similar surfaces oriented opposite to each other. Dividers 180 may also be used in combination with other dividers, such as longitudinal dividers (not shown) to provide additional reinforcement and reduction of dynamic forces during fluid transport. Longitudinal dividers may further compartmentalize the internal volume.

Figure 2:
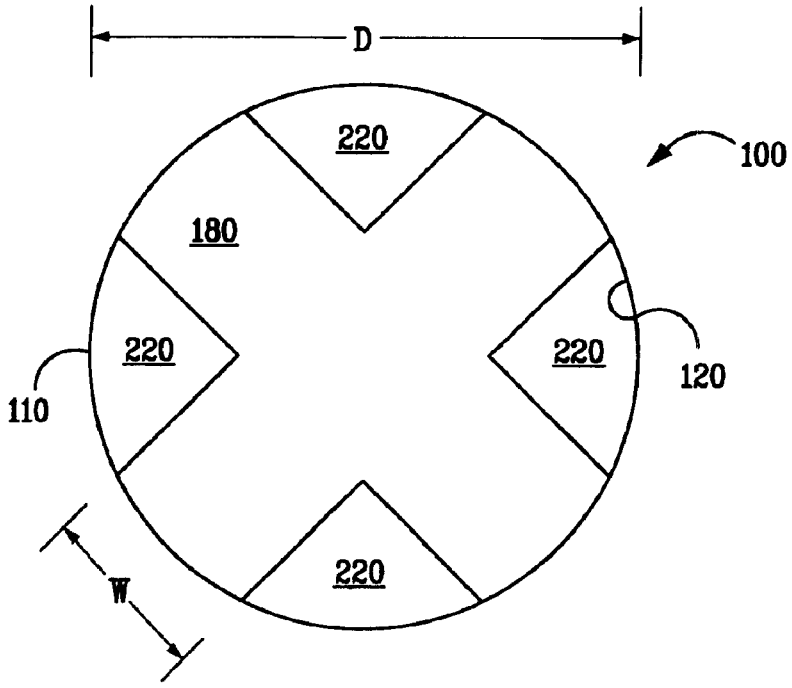
FIG. 2 provides a cross-sectional view taken at line A—A of the vessel of FIG. 1.

FIG. 2 provides a detailed illustration of a divider taken at cross-sectional line A—A of FIG. 1. As FIG. 2 shows, divider 180 contacts internal surface 120 in at least four places. Divider 180 may be attached to the internal surface 120 via fasteners, welding, brackets, or similar means (not shown). Divider 180 may also be integral to, or part of, the internal surface 120 of vessel 100.

FIGS. 1 and 2 depict divider 180 as being cross-shaped. However, divider 180 may be bow tie shaped, star shaped, or any other shape having a plurality of apertures 220 to allow for the flow of fluid within the internal volume 170. Referring to FIG. 2, divider 180 is oriented so that apertures 220 face directly up (North), down (South), right (East), and left (West). Divider 180 has V-shaped apertures 220 defined by the internal surface 120 of the shell 110 or vessel 100. However, other shaped apertures such as, but not limited to, C-shaped or O-shaped may be used. In the certain embodiments such as the embodiment shown in FIG. 2, divider 180 has a leg width "W" that may range from about ⅕ to about ⅗ of the vessel diameter "D".

Referring to FIG. 1, dividers 180 apportion the internal volume 170 into 3 sections: center section 190 and end sections 200 and 210. While FIG. 1 shows two dividers 180, any number of dividers may be used to apportion the internal volume into three or more sections. The volume of the center section (or combined volume of the center sections if more than one) may range from about ⅓ to about ⅔ of the overall volume of vessel. Preferably, the volume of the center section (or sections) and the volume of the end sections are substantially equal.

Vessel 100 further may have one or more fluid inlets 230. If there are more than one fluid inlet 230, the inlets may be located in the same or different sections of the vessel. Fluid inlet 230 allows for the charging and discharging of fluid within the vessel. Fluid inlet 230 may also allow for the purging of the vessel to remove contaminants. In FIG. 1, fluid inlet 230 is a dip tube assembly mounted within valve box 240. In certain preferred embodiments such as the embodiment depicted in FIG. 1, fluid inlet 230 extends into the center section 190 of vessel 100. In other embodiments such as the embodiment depicted in FIG. 4, fluid inlet 230' extends into one of the end sections, either 200' or 210', of the vessel.

In addition, vessel 100 may also have one or more fluid outlets. Fluid outlets may be located in the same or in a different section as the fluid inlet 230. In embodiments where the fluid outlet is located at one end section, an additional fluid outlet is located at the opposite end section for optimal fluid flow.

The orientation of the dividers within the vessel allow for the continuous purge of contaminants from the internal volume. During the purge cycle, a stream of gas is introduced into vessel 100 through one or more fluid inlets, which in FIG. 1, is shown as a dip tube 230 located in the center section 190 of the volume. Referring again to FIG. 1, the gas bounces against the bottom of the container and against dividers 180 and rises up along the vessel walls where contaminants may lie. The gas stream, along with any contaminants swept up from the internal surface 120 of the vessel, then splits into two or more streams and penetrates into end sections 200 and 210 through the top apertures 220 of dividers 180. Once the gas stream and particles enter end sections 200 and 210 of vessel 100, its kinetic energy slowly decays and the gas descends towards the container bottom. The purge gas flow reenters the central container section 190 through the bottom apertures 220 of dividers 180. Stagnation or "dead zones" are substantially eliminated within vessel end sections 200 and 210 since the flow stream descends gradually towards the bottom of the vessel. It is envisioned that other flow streams are possible depending upon a variety of factors such as, the shape of the dividers, the shape of the vessel, the size of the vessel, the number of apertures within the dividers, the number of dividers, the location of the fluid inlet or inlets, the location of the fluid outlet or outlets, the proximity of the fluid inlet(s) and fluid outlet(s), etc. Preferably, the flow rate of the fluid should be sufficient to provide a minimum average gas velocity of 0.5 m/s within the vessel volume.

The invention will be illustrated in more detail with reference to the following examples, but it should be understood that the present invention is not deemed to be limited thereto.

EXAMPLES

The internal flow patterns of several embodiments of the vessel of the present invention were studied using commercially available, general purpose Computational Fluid Dynamics (CFD) computer modeling software from Fluent, Inc. of Lebanon, N.H. Throughout the examples, the term "particles" is analogous to "contaminants" present within the vessel. The position, shape, and orientation of the dividers were evaluated and the CFD results are provided herein.

Example 1

Two Fluid Inlets Extending into Center Section

A vessel having two fluid inlets that extend into the center section of the vessel such as the vessel in the embodiment depicted in FIG. 1 was analyzed by computer modeling. The following dimensions for the vessel were used: vessel diameter=89.3"; vessel length=235.3"; inlet dip tube diameter=2"; gap from each dip tube discharge to the bottom=0.75"; distance between the dip tubes=13.75"; divider width=⅓ of vessel diameter or 29.8"; and distance between the dividers=⅓ of vessel length or 78.4". In the model, the valve box was defined as a rectangle with 300 mm depth as shown in FIG. 1. Two fluid inlets were represented by two circular inlets located at the top of the dip tubes above the valve box surface. Each dip tube was extended to the centerline of the container bottom with a gap between the dip tube end and the container wall of 0.75". Two other valves were represented with two circular outlets, each two inches in diameter. The outlets were positioned at the top of the valve box at an equal distance from the vessel centerline as shown in FIG. 1. In the model, the two dividers divide the vessel into three equal sections. Each divider forms a cross with V-shape apertures at the top, bottom, and both sides of the vessel.

Figure 3A:
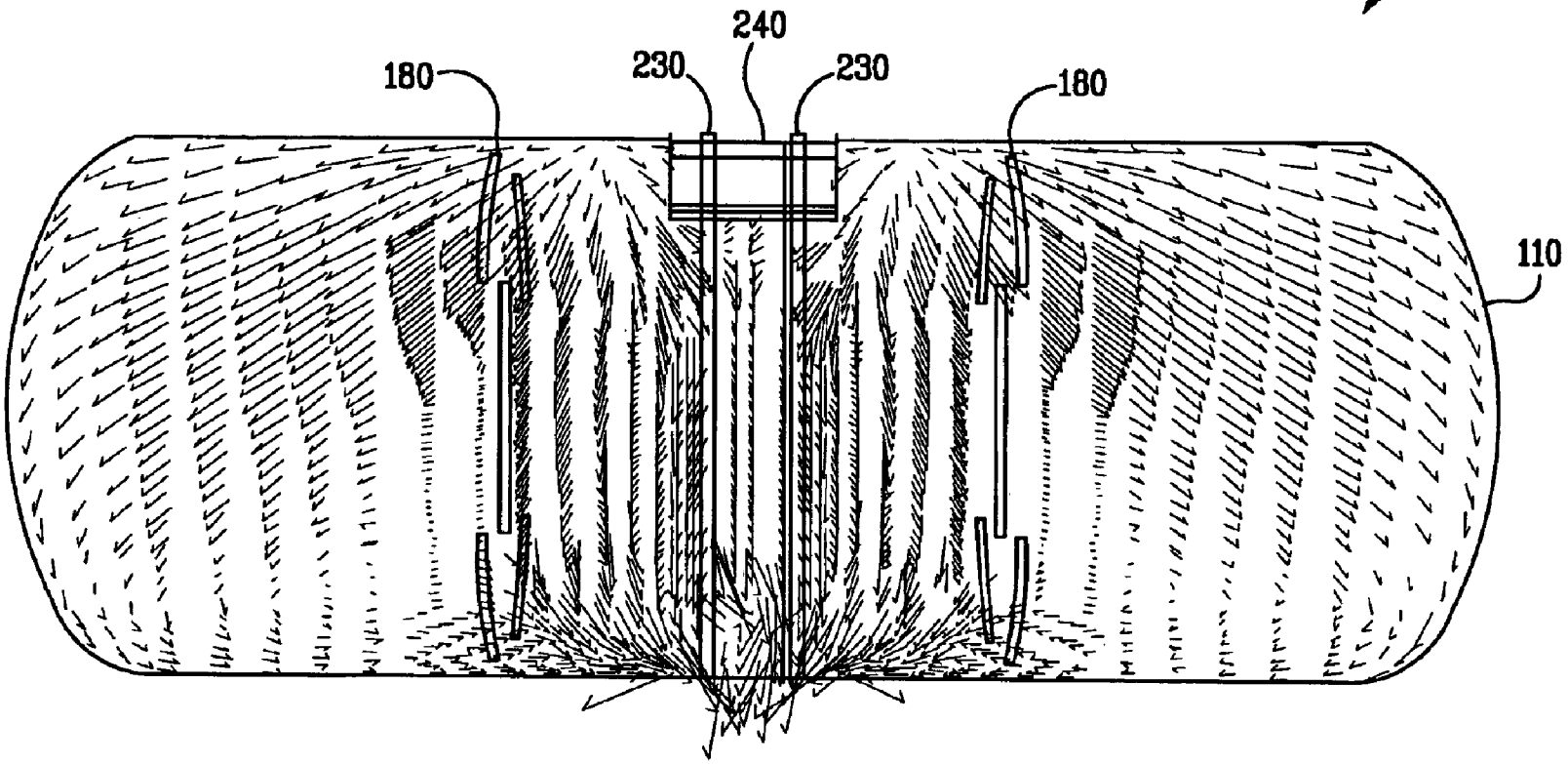
FIG. 3*a* provides the velocity field distribution of the vessel of the FIG. 1 at the vertical center plane of the vessel.
Figure 3B:
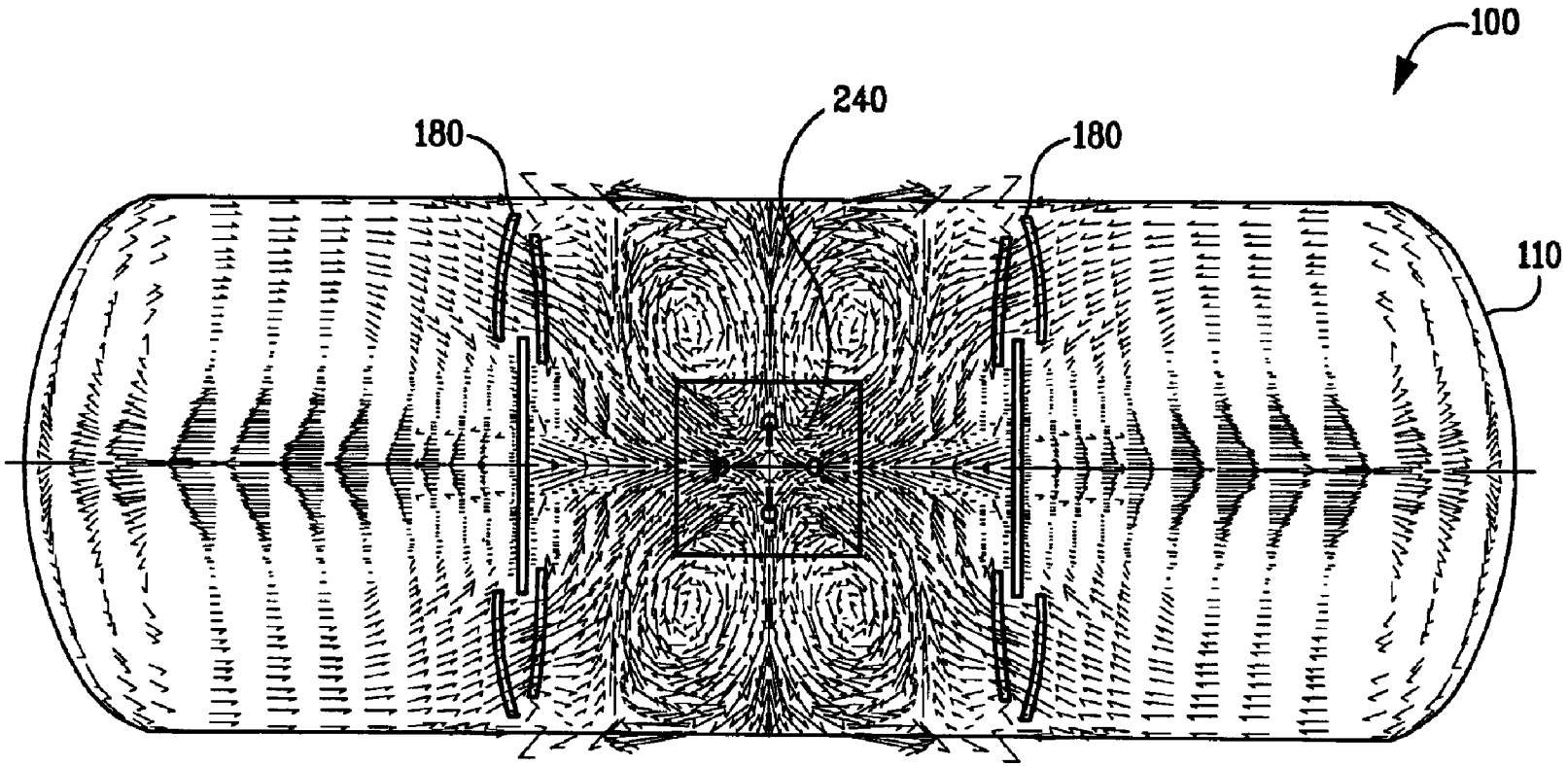
FIG. 3*b* provides the velocity field distribution of the vessel of the FIG. 1 at the horizontal center plane of the vessel.

A continuous purge cycle was simulated by introducing a stream of purge gas through the two fluid inlets at the top of the dip tubes. The flow was allowed to reach steady state. The flow field of the purge gas was calculated inside the tank. FIGS. 3*a* and 3*b* provide the velocity field distribution of the vessel of an embodiment of FIG. 1 along the vertical center plane and horizontal plane respectively.

Referring to FIG. 3*a*, the purge gas stream enters the end sections of the vessel at the top through the top aperture within the dividers. The return flow to the center section of the vessel occurs at the bottom through the bottom aperture of the divider. FIG. 3*a* further shows that between the dividers or in the center section, the purge gas moves upward from the bottom along the vessel walls (flow field is not shown). This aids in vessel pre-cleaning and preparation for UHP product delivery. Referring to FIG. 3*b*, the purge gas stream appears to form eight well-pronounced circulation zones. The gas stream appears significantly weaker at the end sections of the vessel than in the center section. This flow pattern suggests that any relocation of the valve box towards the vessel end section may create stagnation zones at the opposite end section, see, infra, Example 3.

Figure 3C:
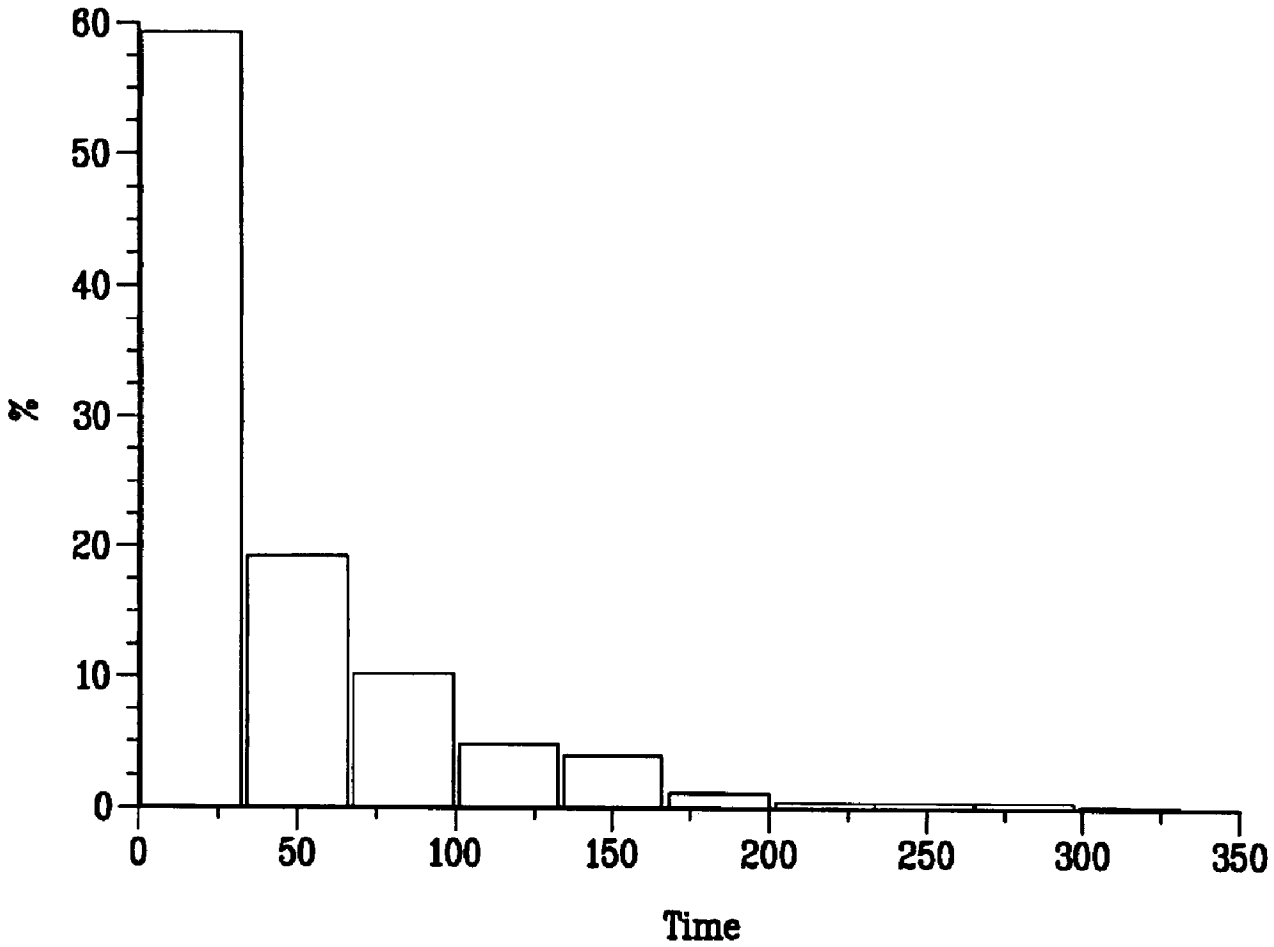
FIG. 3*c* provides a histogram of the particle residence time within the vessel of FIG. 1 during a purge cycle.

A particle tracking technique was used to evaluate the minimum continuous purging time when a quantity of 960 particles is introduced through the fluid inlets into the vessel. This modeling technique was used in lieu of a time dependent calculation, which is impractical with a grid size of about 500,000 nodes. FIG. 3*c* provides a histogram of the particle residence time inside the vessel shown in FIG. 1. The histogram shows that all 960 particles, which were introduced into the vessel through both fluid inlets, escaped through the fluid outlets in less than 300 seconds. This confirms the absence of stagnation zones inside the vessel.

Example 2

One Fluid Inlet Extending into Center Section of Vessel

Figure 5A:
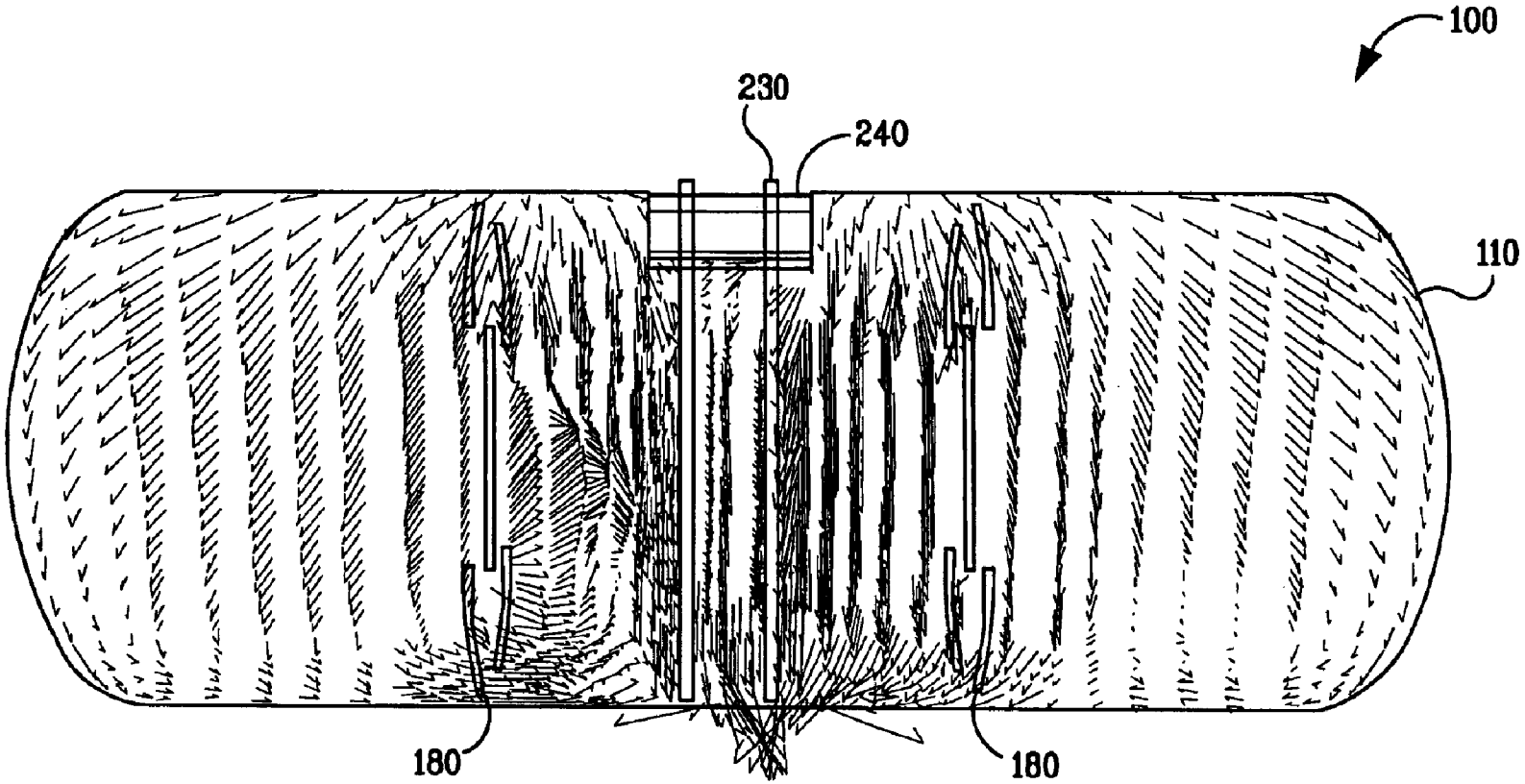
FIG. 5*a* provides the velocity field distribution of an embodiment of the present invention having one fluid inlet extending into the center section of the vessel at the vertical center plane of the vessel.
Figure 5B:
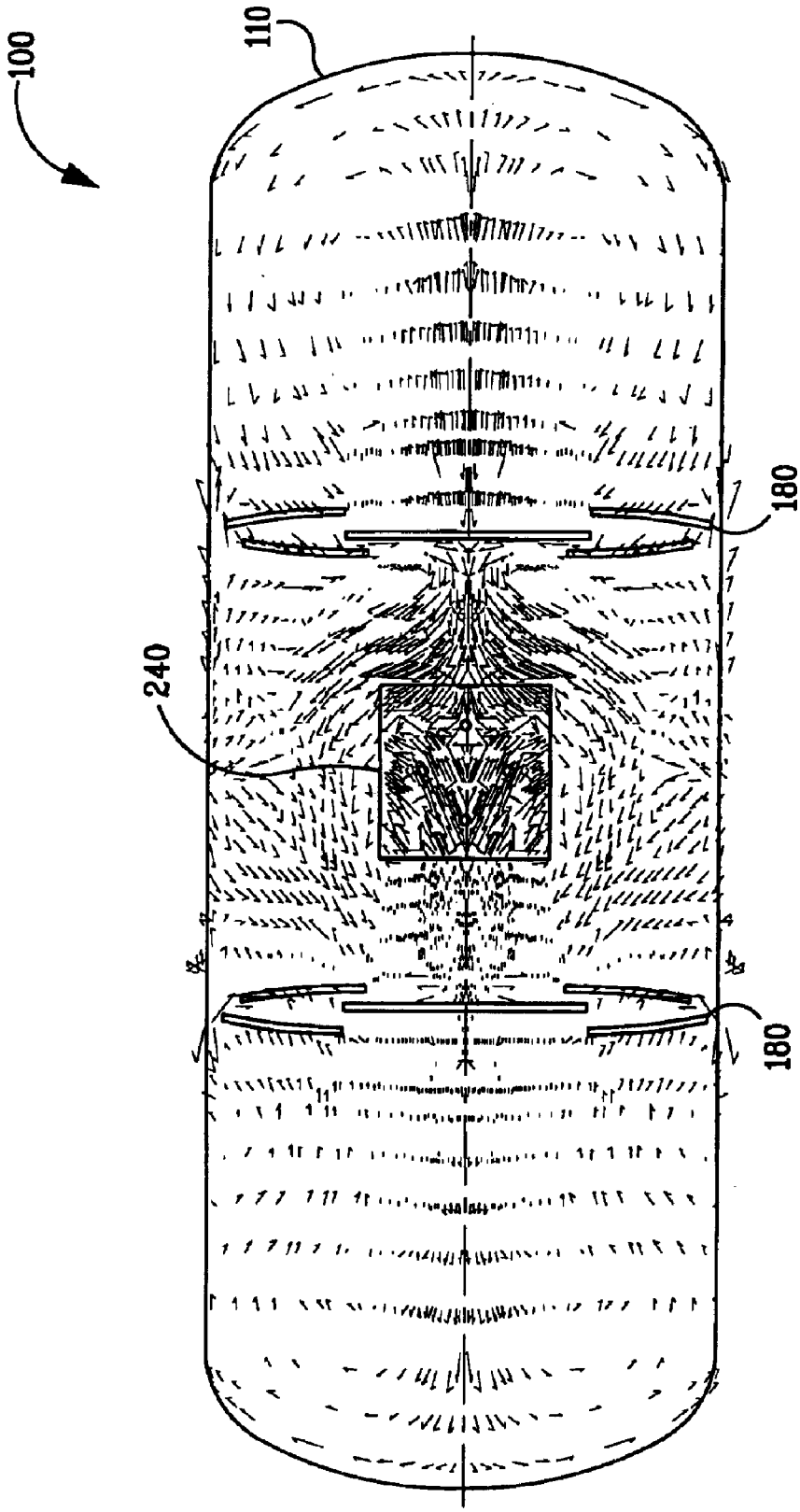
FIG. 5*b* provides the velocity field distribution of an embodiment of the present invention having one fluid inlet extending into the center section of the vessel at the horizontal center plane of the vessel.

CFD modeling was conducted on a vessel having one fluid inlet extending into the center section of the vessel. The dimensions of the vessel are the same as used in Example 1. FIGS. 5*a* and 5*b* provide the velocity field distribution of the vessel along the vertical center plane and horizontal plane respectively. Fluid inlet assembly 230 in FIGS. 5*a* and 5*b* is shown on the right. The left fluid inlet assembly depicted is not used in the model.

A comparison of FIGS. 3*a* and 3*b* with FIGS. 5*a* and 5*b* show that the flow pattern for two fluid inlets vs. one fluid inlet into the center section are similar. However, the purge gas volume exchange and purge gas flow rate may differ (see Table I). Thus, continuous purging of the vessel is possible with one fluid inlet.

Example 3

Two Fluid Inlets Extending into End Section of Vessel

Figure 4:
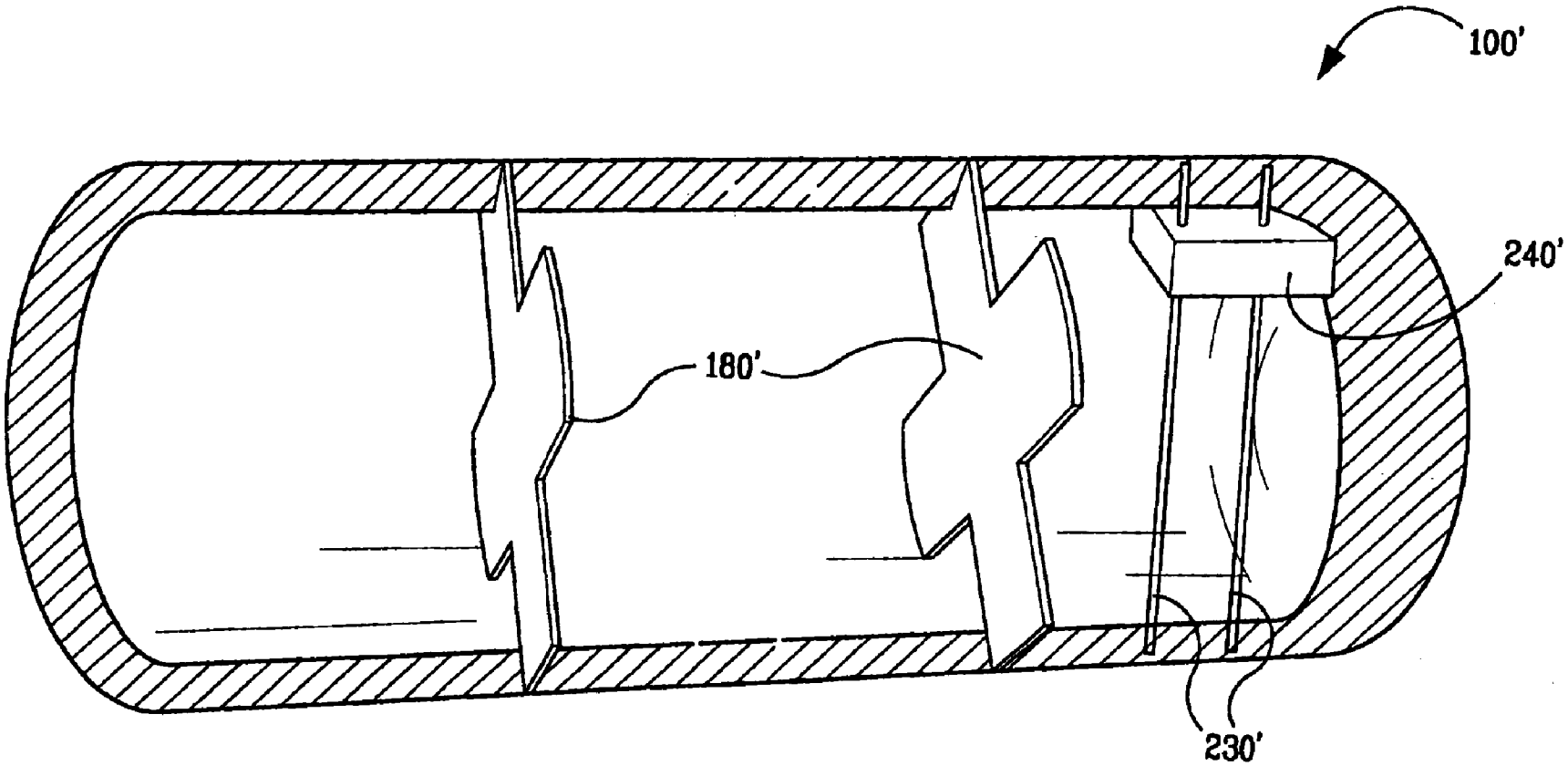
FIG. 4 provides an isometric view of another embodiment of the present invention wherein the valve box is located within the end section of the vessel.
Figure 6A:
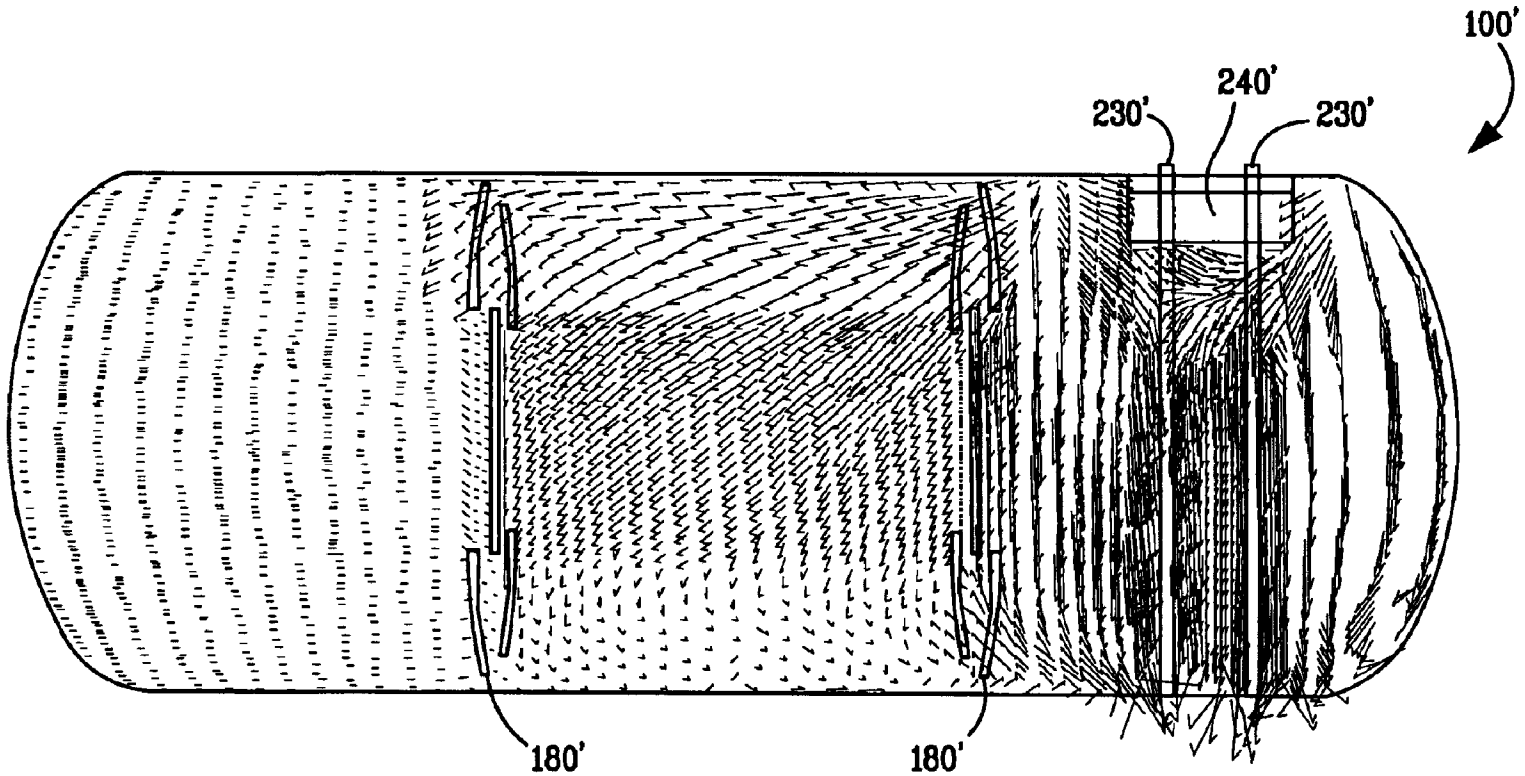
FIG. 6*a* provides the velocity field distribution of the vessel of the FIG. 4 at the vertical center plane of the vessel.
Figure 6B:
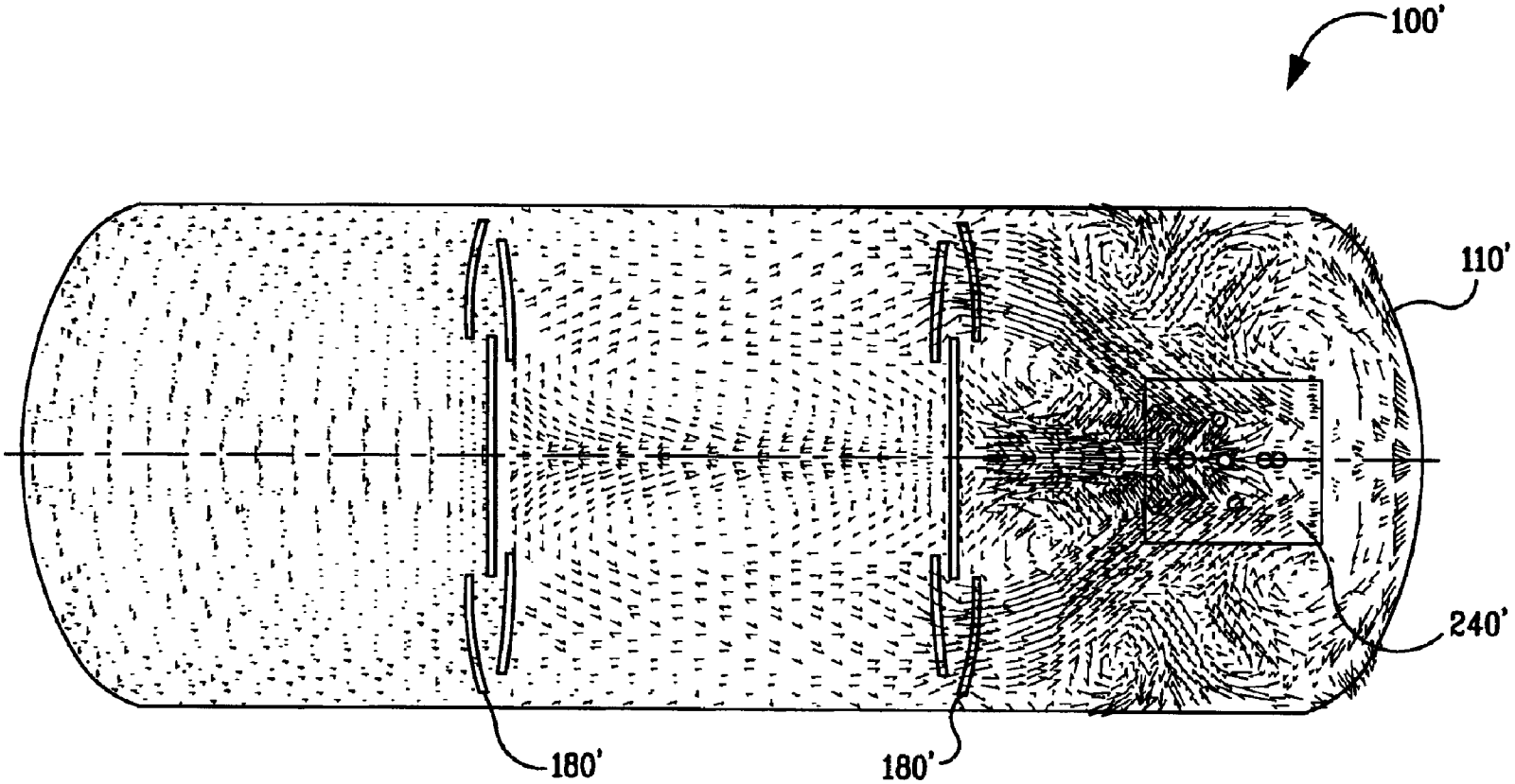
FIG. 6*b* provides the velocity field distribution of the vessel of the FIG. 4 at the horizontal center plane of the vessel.

CFD modeling was conducted on a vessel having two fluid inlets extending into one end section of the vessel as shown in FIG. 4. The dimensions of the vessel are the same as used in Example 1. FIGS. 6*a* and 6*b* provide the velocity field distribution of the vessel of an embodiment of FIG. 4 along the vertical center plane and horizontal plane respectively. Comparing FIGS. 3*a* and 3*b* with FIGS. 6*a* and 6*b*, the high velocity region has moved from the center section of the vessel to the right end section where the fluid inlets are located. As the purge gas propagates along the container from the right end section towards the opposite left end section, the velocity of the gas slows down dramatically. The calculated velocity in the left end section is close to stagnant. Therefore, the flow does not have enough momentum to purge the left end section of the container successfully.

Comparison of Examples 1 Through 3

The purging efficiency and other parameters were compared for examples 1 through 3 and the results of these comparisons are provided in Tables I, II, and III. The purging efficiency of the vessel was evaluated using a Lagrangian frame of reference for all three examples. This model consists of spherical particles representing contaminants dispersed in the continuous phase (purging gas). The particle trajectories were computed. Calculation of the trajectories using a Lagrangian formulation includes the discrete phase inertial, hydrodynamic, and buoyancy forces. The formulation also assumes that the particle stream is sufficiently dilute. The model was based upon the following assumptions: the diameter of each particle is 1 micron and the particle density is 96.8 lb/ft$^3$. A fixed number of particles were released from the fluid inlets. The trajectories of the particles and the particle residence time were calculated. The results for two cycles are provided in Table II. The computed purging time, minimum purging gas volume, and purging efficiency for two cycles are provided in Table III. The comparison shows that Example 1, the vessel having two fluid inlets in the center section of the vessel, provided the greatest purging efficiency of the three vessels.

TABLE I

Comparison of Certain Parameters

| Parameter | Example 1 | Example 2 | Example 3 |
|---|---|---|---|
| Inlet total pressure (psia) | 22 | 22 | 22 |
| Inlet static ressure (psia) | 20.2 | 19.6 | 20.2 |
| Exit static pressure (psia) | 14.7 | 14.7 | 14.7 |
| Gas flow rate at fluid inlet (lb/hr) | 5057.73 | 2959.67 | 5043.95 |
| Vessel fluid volume (ft$^3$) | 789.09 | 789.09 | 789.09 |
| Volume exchange time (s) | 37.05 | 63.32 | 37.16 |
| Avg. velocity at dip tube discharge area | 500.73 | 586.0 | 496.65 |
| Avg. velocity in entire vessel | 7.68 | 7.09 | 6.59 |

TABLE II

Particle Tracking Results

| Parameter | Example 1 | Example 2 | Example 3 |
|---|---|---|---|
| No. of particles tracked | 960 | 480 | 1080 |
| Max. residence time (s) | 140 | 191 | 213 |
| % of particles escaped from exits | 89.2 | 85.6 | 85.0 |
| % of particles remaining in vessel | 10.8 | 14.4 | 15 |
| Max. residence time (s) | 282 | 397 | 387 |
| % of particles escaped from exits | 99.8 | 99.6 | 99.7 |
| % of particles remaining in vessel | 0.2 | 0.4 | 0.3 |

TABLE III

Purging Efficiency

| Parameter | Example 1 | Example 2 | Example 3 |
|---|---|---|---|
| $N_2$ flow rate (lb/s) | 1.4 | 0.82 | 1.4 |
| % of purging completed | 89.2 | 85.6 | 85.0 |
| Purge time (s) | 140 | 191 | 213 |
| $N_2$ purge volume (scf) | 2981 | 2379 | 4523 |
| % of purging completed | 99.8 | 99.6 | 99.7 |
| Purge time (s) | 282 | 397 | 387 |
| $N_2$ purge volume (scf) | 6004 | 4952 | 8217 |

While the invention has been described in detail and with reference to specific examples thereof, it will be apparent to one skilled in the art that various changes and modifications can be made therein without departing from the spirit and scope thereof.

We claim:

1. A method for continuous purging of contaminants from a vessel, the method comprising:

providing the vessel comprising an internal surface, an internal volume, a plurality of dividers that apportions the internal volume into two end sections and an at least one center section wherein at least a portion of the dividers contacts the internal surface of the vessel thereby defining one or more apertures and wherein the one or more apertures within the dividers are substantially in alignment with respect to each other, an at least one fluid inlet that extends into the at least one center section, an at least one fluid outlet, and contaminants contained therein;

introducing a stream of gas into the vessel through the at least one fluid inlet wherein the gas flows into the at least one center section and through the top apertures of the dividers into the two end sections to form a contaminant-laden stream; and removing the contaminant-laden stream from the vessel through the at least one fluid outlet.

2. The method of claim 1 wherein the at least one fluid outlet extends into the at least one center section.

3. The method of claim 1 wherein the at least one fluid outlet extends into an end section.

4. The method of claim 1 wherein the vessel is cylindrical shaped.

5. The method of claim 1 wherein the volume of the at least one center section and the end sections are substantially equal.

6. The method of claim 1 wherein the volume of the at least one center section ranges from about 33% to about 66% of the internal volume.

7. The method of claim 1 wherein the at least one fluid inlet is located on or around the midpoint between the pair of dividers.

8. A method for continuous purging of contaminants from a vessel, the method comprising:

providing the vessel comprising an internal surface, an internal volume, a plurality of dividers that apportions the internal volume into two end sections and an at least one center section wherein at least a portion of the dividers contacts the internal surface of the vessel thereby defining one or more apertures and wherein the one or more apertures within the dividers are substantially in alignment with respect to each other, an at least one fluid inlet and an at least one fluid outlet wherein the at least one fluid inlet and at least one fluid outlet are located within the at least one center section and are proximal to an area selected from top, bottom, east side, and west side of the vessel, and contaminants contained therein;

introducing a stream of gas into the vessel through the at least one fluid inlet wherein the gas flows into the at least one center section, through the apertures of the dividers that are opposite to the area wherein the at least one fluid inlet and at least one fluid outlet are located, and into the two end sections to form a contaminant-laden stream; and removing the contaminant-laden stream from the vessel through the at least one fluid outlet.

9. The method of claim 8 wherein the area in the providing step is the bottom of the vessel and wherein the gas in the introducing step flows through the top apertures.

10. The method of claim 8 wherein the area in the providing step is the top of the vessel and wherein the gas in the introducing step flows through the bottom apertures.

11. The method of claim 8 wherein the area in the providing step is the east side of the vessel and wherein the gas in the introducing step flows through the west apertures.

12. The method of claim 8 wherein the area in the providing step is the west side of the vessel and wherein the gas in the introducing step flows through the east apertures.

* * * * *